US006260333B1

(12) United States Patent
Stamm

(10) Patent No.: US 6,260,333 B1
(45) Date of Patent: Jul. 17, 2001

(54) PRESSURE PAD FOR A CONTAINER BOTTOM SEALING DEVICE

(75) Inventor: John Stamm, Babylon, NY (US)

(73) Assignee: Sharon Manufacturing Co., Inc., Deer Park, NY (US)

( * ) Notice: Subject to any disclaimer, the term of this patent is extended or adjusted under 35 U.S.C. 154(b) by 0 days.

(21) Appl. No.: 09/420,697

(22) Filed: Oct. 19, 1999

(51) Int. Cl.[7] ..... B65B 51/10
(52) U.S. Cl. ..... 53/477; 53/374.2
(58) Field of Search ..... 53/379.2, 565, 53/477, 563, DIG. 2; 493/165, 936, 141, 184; 156/581

(56) References Cited

U.S. PATENT DOCUMENTS

| | | | | |
|---|---|---|---|---|
| 3,120,335 | | 2/1964 | Egleston et al. | 229/43 |
| 3,422,730 | | 1/1969 | Mitzelfelt et al. | 93/36 |
| 3,525,386 | | 8/1970 | Grover | 165/32 |
| 3,912,576 | | 10/1975 | Braun | 156/580 |
| 3,971,300 | | 7/1976 | Bachner | 93/36.3 |
| 4,011,800 | | 3/1977 | Walke | 93/59 MT |
| 4,403,465 | * | 9/1983 | Bachner . | |
| 4,691,734 | | 9/1987 | Fort | 137/493.4 |
| 4,761,156 | | 8/1988 | Bachner et al. | 493/133 |
| 4,838,847 | | 6/1989 | Kume et al. | 493/133 |
| 5,021,040 | | 6/1991 | Phillips | 493/133 |
| 5,135,463 | | 8/1992 | Hyduk | 493/133 |
| 5,321,930 | * | 6/1994 | Poole . | |
| 5,419,801 | * | 5/1995 | McDonald . | |
| 5,482,204 | | 1/1996 | Mills et al. | 229/137 |
| 5,588,943 | | 12/1996 | Mills et al. | 493/58 |
| 5,682,732 | * | 11/1997 | Selberg . | |
| 5,683,339 | | 11/1997 | Mills et al. | 493/58 |
| 5,713,181 | * | 2/1998 | Giacomelli . | |
| 5,762,595 | * | 6/1998 | Santiago et al. . | |

* cited by examiner

*Primary Examiner*—Eugene Kim
(74) *Attorney, Agent, or Firm*—Davis & Bujold, P.L.L.C.

(57) ABSTRACT

A pressure pad for sealing a carton made from paperboard. The pressure pad comprises a top surface having a variety of components lying in a first plane, and a variety of recesses being formed within the pressure pad, on a base lower surface of the pressure pad all lie within a third plane. A remainder of the pressure pad components lies in an intermediate plane. The pressure sealing surfaces of the pressure pad arrange to form an H-shaped sealing configuration in the paperboard carton to be sealed. The pressure pad, according to the present invention, provides an improved seal for the carton, manufactured from paperboard, to prevent the exposed raw edges of the paperboard of wicking moisture either into or out of a container. The improved sealing design, achieved by the pressure pad, according to the present invention, increases the shelf life of products being stored in containers manufactured from the improved pressure pad.

20 Claims, 11 Drawing Sheets

PRESSURE PAD FOR A CONTAINER BOTTOM SEALING DEVICE

FIELD OF THE INVENTION

This invention relates to a new and improved container bottom sealing device, such as a pressure pad, for securely sealing a multi-layer folded container bottom of a thermoplastic coated paperboard container to prevent leakage of the contents, contained within the formed container, as well as to prevent contamination of contents by any external source or the surrounding environment.

BACKGROUND OF THE INVENTION

Thermoplastic coated paperboard containers are commonly utilized for storage and retention of different materials, including liquids such as milk, juice and creams, as well as solids, gels and other known materials which can be effectively stored for a period of time, e.g. a few days to a few weeks or so, in this type of container. Such thermoplastic coated cartons are generally formed in the manner of a gabled container and have been used for several decades to contain all types of fluids, solids, powders, and other materials with reasonable success. One drawback, however, with the use of such cartons is the quality and adequacy of the seams and seals along which the paperboard is cut and folded to form the resulting container. In particular, it is the bottom surface of such containers where the contents of the container are in almost continuous and constant contact with the formed seams, folds and exposed edges of the paperboard which causes failure in the integrity of the container bottom.

A gable carton is typically formed from a single blank of paperboard material with an array of score lines about which the paperboard material is folded to form the resulting carton. With reference to FIG. 1, a typical blank for a prior art half gallon gable carton is identified generally by the numeral 10. The prior art blank 10 includes first through fourth rectangular side wall panels 12, 14, 16, and 18 and a side glue panel 20 which are consecutively articulated to one another along parallel fold lines 13, 15, 17 and 19, respectively. The first side wall panel 12 is further defined by a raw edge 11 of paperboard material which extends parallel to the fold line 13. A first bottom fold line 21 and a first top fold line 22 extend between the raw edge 11 and fold line 13.

A first bottom panel 23 is articulated to the first side panel 12, of the prior art blank 10, along the first bottom fold line 21. The first bottom panel 23 is further defined by a side raw edge 24 which extends generally collinearly from the raw edge 11. The first bottom panel 23 is further defined by a fold line 25 which extends collinearly from the fold line 13 and by a bottom raw edge 26 which extends between the side raw edge 24 and the fold line 25. The bottom raw edge 26 typically will be disposed at an interior most location on the gable carton formed from the prior art blank 10.

A first top panel 28 is articulated to the first side panel 12 along the first top fold line 22. The first top panel 28 is further defined by a side raw edge 29 which extends collinearly from the raw edge 11 and by a fold line 30 which extends collinearly from the fold line 13. A fold line 31 extends between the side raw edge 29 and the fold line 30 to define the first top panel 28. A first top seal panel 33 is articulated to the rectangular first top panel 28 along fold line 31. A diagonal fold line extends from the intersection of fold lines 30 and 22 to a central region of fold line 31.

The second side panel 14 is further defined by a second bottom fold line 41 and a second top fold line 42. A second bottom panel 43 is articulated to the second side panel 14 along the second bottom fold line 41. The second bottom panel 43 is further defined by two converging fold lines 44, 45. A first triangular web panel 46 is articulated to the second bottom panel 43, along the fold line 44, and is articulated to the first bottom panel 23 along the fold line 25. The first triangular web panel 46 is further defined by a raw edge 47 which extends between the fold lines 25, 44. A second triangular web panel 48 is similarly articulated to the second bottom panel 43 along fold line 45. The second triangular web panel 48 is defined further by a fold line 49 which extends collinearly from the fold line 15 and by fold line 45 and raw edge 50.

A second top panel 51 is articulated to the second side panel 14 along the second top fold line 42. The second top panel 51 is defined further by converging fold lines 52 and 53. First and second triangular web panels 54,55 are articulated to the second top panel 51 along fold lines 52 and 53, respectively. The first triangular web panel 54 is further articulated to the first top panel 28, along fold line 30, and is defined further by fold line 56. The triangular web panel 55 is similarly defined further by fold line 57 which extends collinearly from the fold line 15 and by fold line 58 which extends collinearly from the fold line 56. Top seal panels 59 and 60 are articulated to the web panels 54 and 55, respectively, along the fold lines 56 and 58.

The third side panel 16 of the prior art blank 10 is further defined by a third bottom fold line 61 and a third top fold line 62. A third bottom panel 63 is articulated to the third side panel 16 along the third bottom fold line 61. The third bottom panel 63 is articulated to the second triangular bottom web panel 48 along fold line 49 and is defined further by side raw edge 65 which extends collinearly from the fold line 49 and generally orthogonal to the raw edge 50 of the bottom web panel 48; a transverse raw edge 66 which extends orthogonally from the side raw edge 65 a major distance across the third bottom panel 63; and, a diagonal raw edge 67 which extends between the bottom raw edge 66 and a fold line 64. As will be explained below in further detail, the third bottom panel 63 defines an external wall of the gable carton erected from the prior art blank 10, and the raw edges 65, 66 and 67 of the third bottom panel 63 are substantially exposed on exterior regions of the carton.

A generally rectangular third top panel 68 is articulated to the third side panel 16 along fold line 62. The third top panel 68 is articulated to the top second triangular web panel 55 along fold line 57 and is defined further by fold line 69 which extends collinearly from the fold line 17 and by fold line 70 which extends parallel to fold line 62, between the fold lines 57 and 69. A second top seal panel 72 is articulated to the third top panel 68 along fold line 70. A diagonal fold line extends from the intersection of fold lines 57 and 62 to a central region of fold line 70.

The fourth side panel 18 of the prior art blank 10 is defined further by a fourth bottom fold line 73 and a fourth top fold line 74 which extend orthogonally between the fold lines 17 and 19. A fourth bottom panel 75 is articulated to the fourth side panel 18 along fold line 73. The fourth bottom panel 75 is further defined by converging fold lines 76 and 77. A first triangular bottom web panel 78 is articulated to the third bottom panel 63, along fold line 64, and is further articulated to the fourth bottom panel 75 along fold line 76. The first triangular web panel 78 is further defined by a raw edge 79 which extends from the diagonal raw edge 67 generally orthogonal to the fold line 64. A second triangular web panel 80 is similarly articulated to the fourth bottom panel 75 along fold line 77. The second triangular web panel 80 is defined further by a raw edge 81 and by fold line 82 which extends collinearly from the fold line 19.

A fourth top panel 83 is articulated to the fourth side panel 18 along fold line 74. The fourth top panel 83 is defined further by converging fold lines 84 and 85. A first triangular web panel 86 is articulated to the third top panel 68, along fold line 69, and is articulated to the fourth top panel 83 along fold line 84. The first triangular web panel 86 is defined further by fold line 87 which extends substantially collinearly from the fold line 70. A second triangular web panel 88 is similarly articulated to the fourth top panel 83 along fold line 85. The second triangular web panel 88 is defined further by fold line 89 extending collinearly from the fold line 19 and by fold line 90. Top seal panels 91 and 92 are articulated to the web panels 86 and 88 along fold lines 87 and 90, respectively.

The side glue panel 20, of the prior art blank 10, is defined further by top and bottom fold lines 93 and 94 and by a raw side edge 95. A bottom glue panel 96 is articulated to the web panel 80, along fold line 82, and to the side glue panel 20 along fold line 93. The bottom glue panel 96 is defined further by a diagonal raw edge 97 and by a side raw edge 98 which extends collinearly from the side edge 95. A top glue panel 99 is similarly articulated to the top web panel 88, along fold line 89, and to the side glue panel 20 along fold line 94. The top glue panel 99 is defined further by a raw side edge 100 which extends collinearly from the raw edge 95 of the side glue panel 20.

The prior art blank 10 is cut and scored by the paperboard manufacturer in a conventional fashion. The paperboard manufacturer also typically will fold the glue panels 20, 96 and 99, relative to the remainder of the prior art blank 10, about the collinear fold lines 19, 82 and 89, respectively. The entire prior art blank 10 will further be folded substantially in half about the collinear fold lines 15, 49 and 57. The glue panels 20, 96 and 99 then will be securely adhered to the first side panel 12, the first bottom panel 23 and the first top panel 28, respectively, such that the fold lines 19, 82 and 89 are located substantially adjacent the raw edges 11, 24 and 29, respectively. In this folded condition, the glue panels 20, 96 and 99 will be adhered to an inner surface of the first side panel 12, the first bottom panel 23 and the first top panel 28 that will define the interior of the resulted carton erected from the prior art blank 10. It will be appreciated that according to the procedure set forth above, the folded blank will be substantially flat with the first side panel 12 being in a substantially face-to-face relationship with the fourth side panel 18 and the second side panel 14 being in a substantially face-to-face relationship with the third side panel 16. Thereafter, the folded prior art blank 10 will typically be shipped from the paperboard manufacturer to a diary or some other producer of a liquid, powder, gel, fluid, etc. to be stored in the container formed from the prior art blank 10.

With reference to FIG. 1A, a typical blank for a prior art pint or quart gable carton is identified generally by the numeral 210. The prior art blank 210 includes first through fourth rectangular side wall panels 212, 214, 216, and 218 and a side glue panel 220 which are consecutively articulated to one another along parallel fold lines 213, 215, 217 and 219, respectively. The first side wall panel 212 is further defined by a raw edge of paperboard material 211 which extends parallel to a fold line 213. A first bottom fold line 221 and a first top fold line 222 extend between the raw edge 211 and the fold line 213 to further define the first side panel 212.

A first bottom panel 223 is articulated to the first side panel 212, of the prior art blank 210, along the first bottom fold line 221. The first bottom panel 223 is further defined by a side raw edge 224 which extends generally collinearly from the raw edge 211. The first bottom panel 223 is further defined by a fold line 225 which extends collinearly from the fold line 213 and by a bottom raw edge 226 which extends between the side raw edge 224 and the fold line 225. The bottom raw edge 226 typically will be disposed at an interior most location on the gable carton formed from the prior art blank 210.

A first top panel 283 is articulated to the first side panel 212 along fold line 222. The first top panel 283 is defined further by converging fold lines 284 and 285. A first triangular web panel 286 is articulated to the first top panel 283, along fold line 284. The first triangular web panel 286 is defined further by side raw edge 289 which extends substantially collinearly with raw edge 211 and by fold line 287. A second triangular web panel 288 is similarly articulated to the first top panel 283 along fold line 285. The second triangular web panel 288 is defined further by fold line 229 extending collinearly from the fold line 213 and by fold line 290. Top seal panels 291 and 292 are articulated to the triangular web panels 286 and 288 along fold lines 287 and 290, respectively.

The second side panel 214 is further defined by a second bottom fold line 241 and a second top fold line 242. A second bottom panel 243 is articulated to the second side panel 214 along the second bottom fold line 241. The second bottom panel 243 is further defined by two converging fold lines 244, 245. A first triangular web panel 246 is articulated to the second bottom panel 243, along the fold line 244, and is articulated to the first bottom panel 223 along the fold line 225. The first triangular web panel 246 is further defined by a raw edge 247 which extends between the fold lines 225, 244. A second triangular web panel 248 is similarly articulated to the second bottom panel 243 along fold line 245. The second triangular web panel 248 is defined further by a fold line 249 which extends collinearly from the fold line 215 and by fold line 245 and raw edge 250.

A second top panel 228 is articulated to the second side panel 214 along the second top fold line 242. The second top panel 228 is further articulated to the triangular web panel 288 along fold line 229 which extends collinearly from fold line 213 and by fold line 230 which extends collinearly from the fold line 215. A fold line 231 extends between the fold lines 229 and the fold line 230 to further define the first top panel 228. A first top seal panel 233 is articulated to the rectangular first top panel 228 along fold line 231. A diagonal fold line extends from the intersection of fold lines 230 and 242 to a central region of fold line 231.

The third side panel 216 of the prior art blank 210 is further defined by a third bottom fold line 261 and a third top fold line 262. The third bottom panel 263 is articulated to the third side panel 216 along the third bottom fold line 261. The third bottom panel 263 is articulated to the bottom web panel 248 along fold line 249 and is defined further by side raw edge 265 which extends collinearly from the fold line 249 and generally orthogonal to the raw edge 250 of the bottom web panel 248; a transverse raw edge 266 which extends orthogonally from the side raw edge 265 a major distance across the third bottom panel 263; and, a diagonal raw edge 267 which extends between the bottom raw edge 266 and the fold line 264. As will be explained below in further detail, the third bottom panel 263 defines an external wall of the gable carton erected from the prior art blank 210, and the raw edges 265, 266 and 267 of the third bottom panel 263 are substantially exposed on exterior regions of the carton.

A third top panel 251 is articulated to the third side panel 216 along the third top fold line 262. The third top panel 251 is defined further by converging fold lines 252 and 253. First and second triangular web panels 254, 255 are articulated to the third top panel 251 along fold lines 252 and 253, respectively. The first triangular web panel 254 is further defined by the fold line 230 which extends collinearly with fold line 215 and by fold line 256. The second triangular web panel 255 is similarly defined further by fold line 257 which extends collinearly from the fold line 217 and by fold line 258 which extends collinearly from the fold line 256. Top seal panels 259 and 260 are articulated to the web panels 254 and 255, respectively, along the fold lines 256 and 258.

The fourth side panel 218 of the prior art blank 210 is defined further by a fourth bottom fold line 273 and a fourth top fold line 274 which extend orthogonally between the fold lines 217 and 219. A fourth bottom panel 275 is articulated to the fourth side pane 218 along fold line 273. The fourth bottom panel 275 is further defined by converging fold lines 276 and 277. A first triangular bottom web panel 278 is articulated to the third bottom panel 263, along fold line 264, and is further articulated to the fourth bottom panel 275 along fold line 276. The first triangular web panel 278 is further defined by a raw edge 279 which extends from the diagonal raw edge 267 generally orthogonal to the fold line 264. A second triangular web panel 280 is similarly articulated to the fourth bottom panel 275 along fold line 277. The second triangular web panel 280 is defined further by a raw edge 281 and by fold line 282 which extends collinearly from the fold line 219.

A generally rectangular fourth top panel 268 is articulated to the fourth side panel 218 along fold line 274. The fourth top panel 268 is articulated to the second triangular web panel 255 along fold line 257 and is defined further by fold line 269 which extends collinearly from the fold line 219 and by fold line 270 which extends parallel to fold line 274, between the fold lines 257 and 269. A second top seal panel 272 is articulated to the fourth top panel 268 along fold line 270. A diagonal fold line extends from the intersection of fold lines 257 and 274 to a central region of fold line 270.

The side glue panel 220, of the prior art blank 210, is defined further by bottom and top fold lines 293 and 294 and by a raw side edge 295. A bottom glue panel 296 is articulated to the second triangular web panel 280, along fold line 282, and to the side glue panel 220 along fold line 293. The bottom glue panel 296 is defined further by a diagonal raw edge 297 and by a side raw edge 298 which extends collinearly from the raw side edge 295. A top glue panel 299 is similarly articulated to the fourth panel 268, along fold line 269, and to the side glue panel 220 along fold line 294. The top glue panel 299 is defined further by a raw side edge 300 which extends collinearly from the raw side edge 295 of the side glue panel 220.

The prior art blank 210 is cut and scored by the paperboard manufacturer in a conventional fashion. The paperboard manufacturer also typically will fold the glue panels 220, 296 and 299, relative to the remainder of the prior art blank 210, about the collinear fold lines 219, 282 and 269, respectively. The entire prior art blank 210 will further be folded substantially in half about the collinear fold lines 215, 230, and 249. The glue panels 220, 296 and 299 then will be securely adhered to the first side panel 212, the first bottom panel 223 and the first top panel 283, respectively, such that the fold lines 219, 282 and 269 are located substantially adjacent the raw edges 211, 224 and 289, respectively. In this folded condition, the glue panels 220, 296 and 299 will be adhered to inner surfaces of the first side panel 212, the first bottom panel 223 and the first top panel 283 that will define the interior of the resulted carton erected from the prior art blank 210. It will be appreciated that according to the procedure set forth above, the folded blank will be substantially flat with the first side panel 212 being in a substantially face-to-face relationship with the fourth side panel 218 and the second side panel 214 being in a substantially face-to-face relationship with the third side panel 216. Thereafter, the folded prior art blank 210 will typically be shipped from the paperboard manufacturer to a diary or some other producer of a liquid, powder, gel, fluid, etc. to be stored in the container formed from the prior art blank 210.

The diary or other producer will have the necessary equipment for forming and sealing the quart or half gallon prior art blank 10 or 210 into a gable carton. The equipment will be operative to form the collapsed prior art blank 10 or 210 into a generally tubular open ended structure. Thereafter, the bottom end of the open ended tubular structure is closed by folding the second and fourth bottom panels 43 and 75 or 345 and 375 inwardly about the second and fourth bottom fold lines 41 and 73 or 241 and 273, respectively. Next, the first and third bottom panels 23 and 63 or 223 and 263 will then be folded inwardly about the first and third bottom fold lines 21 and 61 or 221 and 261, respectively. This latter folding is carried out such that the first bottom panel 23 or 223 leads the third bottom panel 63 or 263. Thus, the bottom raw edge 26 or 226 of the first bottom panel 23 or 223 will be located interiorly relative to the third bottom panel 63 or 263. However, the side raw edge 24 or 224 of the first side panel 23 or 223 will be substantially exposed to the external environment along a bottom edge of the gable carton formed from the prior art blank 10, as shown in FIG. 2, or 210 as shown in FIG. 2A. The raw edges 65, 66 and 67 or 265, 266 and 267, of the third bottom panel 63 or 263, will be similarly exposed in a position extending substantially centrally across the bottom of the resulting gable carton formed from the prior art blank 10, 210. The folded bottom panels 23, 43, 63 and 75 or 223, 243, 263 and 275 are then adhered to one another in overlapping relationship by a convention hot melt application. The above described gable carton forming process is carried out by placing the folded bottom of the carton on a pressure pad, and by urging a mandrel downwardly in through the open top end of the partially formed gable carton structure. The sealing of the bottom of the carton is achieved by appropriate application of heat and pressure, by the pressure pad and the mandrel.

More effective sealing of the carton bottom may be achieved by providing short linear embossments at desired locations on the pressure pad. These embossments are disposed to orthogonally intersect certain fold lines on the bottom of the panel. Additionally, the embossments may be disposed at locations on the third bottom panel that register with edge regions of panels located interiorly of the third bottom panel. These short discontinuous embossments provide a more secure sealing at selected locations on the bottom of the panel.

As a result of the above describe assembly, the prior art paperboard blank 10 or 210 is formed into an open-topped sealed bottom carton. The open-topped carton can be conveyed to a filling station, of the dairy or other production facility, where the product contents are deposited within the open-topped sealed bottom carton. The open-topped sealed bottom carton is then conveyed to a top sealing station where the second and fourth top panels 51 and 83 of the half gallon container or the first end third top panels 83, 251 of the quart blank are bent toward one another and where the first and third top panels 28 and 68 of the half gallon blank and the second and fourth top panels 228, 268 of the quart blank are then bent toward one another to close the top of the open-topped sealed bottom carton. The various top panels are then sealed by application of appropriate heat and pressure to the seal panels 33, 59, 60, 72, 91 and 92 or 233, 259, 260, 272, 291 and 292 and form a completely sealed gable top container.

It is to be appreciated that the paperboard material, from which the prior art blank is formed, is a fibrous material which has a natural tendency to absorb a liquid. The opposed faces of the prior art blank typically will be coated with a plastic or foil to render these surfaces substantially impermeable to liquids and/or gases. However, the edge regions of the prior art blank are capable of absorbing liquid and function as a "wick" which enable the absorbed liquid(s) to travel from an edge location in the paperboard material toward an interior location spaced from the edge. The absorption of a liquid(s) and the wicking of the absorbed liquid(s), from edge regions of the glue panels disposed interiorly on the carton, can be prevented by removing all or a major portion of the paperboard material along the raw edge, but leaving the coating or foil. The remaining coating or foil can then be folded over the raw edge to seal the raw edge and prevent absorption and wicking of liquid(s).

It is to be appreciated that gable cartons, filled with milk or other beverages, often will be transported along conveyors and may be stored in trucks or coolers where liquid may accumulate on a transportation or storage surface, if these surfaces are not constantly maintained clean. Thus, the external raw edges of the formed gable carton, particularly the raw edges near the bottom of the gable carton, are likely to absorb and wick a lubricant(s) or some other fluid(s) with which the gable carton may eventually come into contact.

It is to be appreciated that the filled and sealed gable cartons may be stored for many days, thus allowing ample time for such extraneous liquids to be wicked into the paperboard material and cause discoloration of the carton and/or contamination of the liquid, powder, gel, or other contents stored therein. Furthermore, the wicking of liquids into the paperboard material, defining the bottom of the carton, can affect the overall structural integrity of the formed gable carton or cause leakage of the material stored in the carton.

In particular, it is the inability of previous bottom sealing methods and apparatus to adequately and properly seal the multitude of different papers comprising the range of multilayer folded bottoms of such cartons. The sealing process is particularly important as it relates directly to the shelf life of the fluid product and retardation of spoilation of the product contained therein as well as to the integrity of the container. Obviously the longer the shelf life of the product, the more economical the production.

As is well known in the art, there are numerous examples of carton sealing apparatus. For example, U.S. Pat. No. 3,912,576 to Braun relates to a sealing apparatus for sealing a rectangular end closure of the thermoplastic coated paperboard by ultrasonic vibrations. Braun's apparatus includes a mandrel or backup member and an ultrasonic vibrating pressure pad tool. The ultrasonic vibrating tool, which provides a bow-tie type profile sealing configuration on its face, engages the end closure opposite the mandrel and, by squeezing the end closure therebetween, seals the folded multilayer rectangular bottom end closure of the container.

U.S. Pat. No. 3,971,300 to Bachner also relates to a pressure pad in combination with a mandrel. Bachner's pressure pad has a multiplicity of surfaces which lie in at least two distinct planes and are shaped to receive and engage the desired carton sections, specifically the tabs and panels of the folded bottom closure of the carton thus placing appropriate pressure along these seams to properly seal the same.

The above referenced methods and apparatus have proved adequate to seal and close the bottom of thermoplastic multilayered folded container for a relatively short period of time. However, there is a need to improve the seal formed on the bottom of the gable container to reduce or eliminate the tendency of the raw edges to absorb and/or wick moisture which is applicable for a wide range of shapes and sizes of the gable cartons.

SUMMARY OF THE INVENTION

Wherefore, it is an object of the present invention to overcome the aforementioned problems and drawbacks associated with the prior art designs.

An object of the present invention is to provide an apparatus for forming a gable carton with seams which reduce or eliminate the tendency of the cartons exposed raw edges to absorb and/or wick moisture.

A further object of the present invention is to provide an apparatus for forming a gable carton bottom with a substantially reduced tendency to absorb liquids.

Another object of the subject invention is to provide a pressure pad for sealing the bottom of a gable carton to substantially eliminate absorption and wicking of liquids through the bottom of the carton.

A further object of the subject invention is to provide a gable carton having a bottom formed to prevent or minimize absorption and wicking of fluids along raw edges of the paperboard material from which the gable carton is formed.

Yet another object of the invention is to provide a pressure pad having a configuration which is capable of sealing a broad range of papers which are utilized to fabricate gabled cartons of various shapes, configurations and sizes.

The present invention further relates to a pressure pad having a configuration which is capable of sealing at least five different layers of papers which are utilized to fabricate the resulting gabled carton.

The present invention relates to a pressure pad for sealing a carton made from paperboard, the pressure pad comprising: a top surface having at least one component lying in a first plane, at least one component lying in an intermediate plane, and at least one component lying in a third plane; the pressure pad having a pair of opposed chevrons being located in a central portion of the top surface of the pressure pad, a set of parallel arranged tracks, for engaging with a glue panel of the paperboard, being spaced from the pair of chevrons, a plurality of dam pits being located to facilitate sealing of a desired container, and the pair of chevron, the set of railroad tracks and the plurality of dam pits all lying in the first plane; a plurality of recesses being formed in a top surface of the pressure pad, and the plurality of recesses each having a surface lying in the third plane; and a remaining surface of the pressure pad lying in the intermediate plane and facilitating sealing of the base of the container.

The present invention relates to a method for sealing a carton made from paperboard with a pressure pad, said method comprising the steps of: forming a pressure pad with at least one component lying in a first plane, at least one component lying in an intermediate plane, and at least one component lying in a third plane; forming a pair of opposed chevrons in a central portion of the top surface of the pressure pad; forming a set of parallel arranged tracks, for engaging with a glue panel of the paperboard, spaced from the pair of chevrons; forming a plurality of dam pits located to facilitate sealing of a desired container, with the pair of chevron, the set of railroad tracks and the plurality of dam pits all lying in the first plane; forming a plurality of recesses in a top surface of the pressure pad with the plurality of recesses each having a surface lying in the third plane; and forming a remaining surface of the pressure pad to lie in the intermediate plane and facilitating sealing of the base of the container.

BRIEF DESCRIPTION OF THE DRAWINGS

The invention will now be described, by way of example, with reference to the accompanying drawings in which.

DESCRIPTION OF THE PREFERRED EMBODIMENTS

Figure 3A:
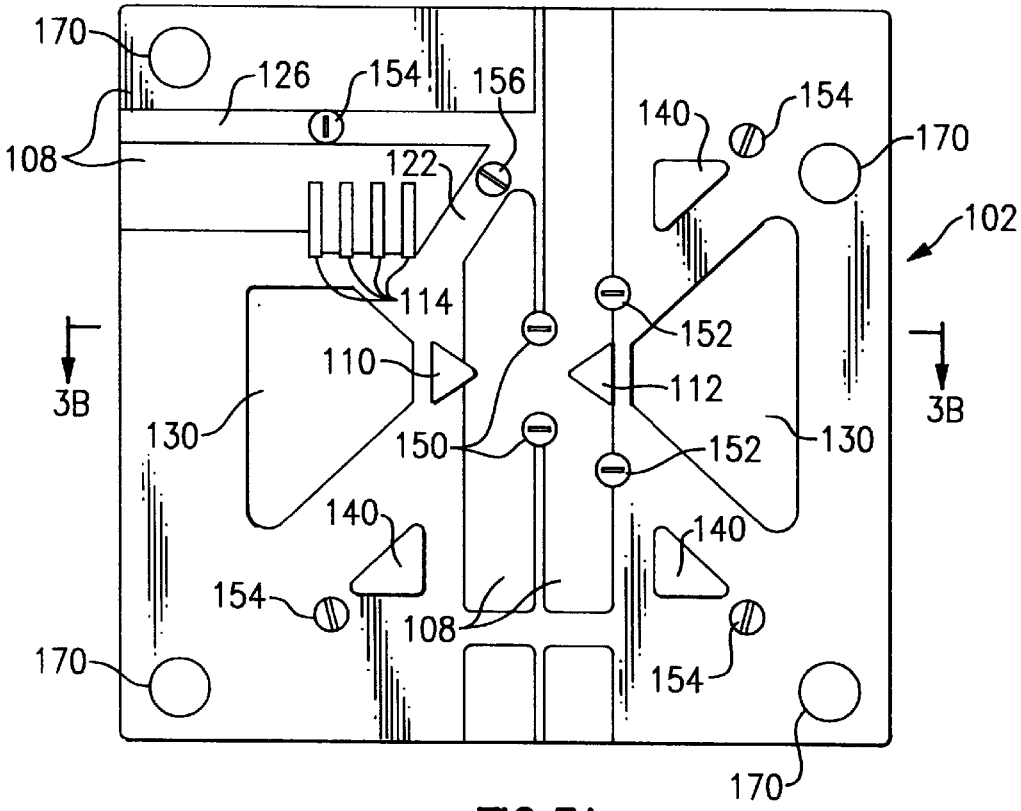
FIG. 3A is a diagrammatic top plan view of the improved quart pressure pad according to the present invention.
Figure 3B:
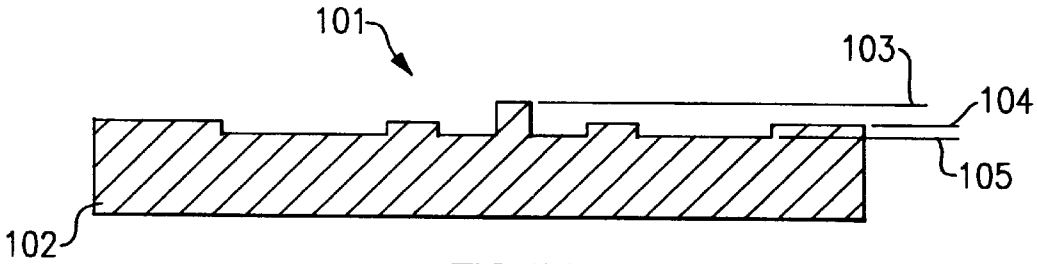
FIG. 3B is a diagrammatic cross sectional view along section line 3B—3B of FIG. 3A.

Turning now to FIGS. 3A and 3B, a detailed description concerning the improved pressure pad of the present invention will now be provided. As can be seen in these Figures, pressure pad 102 comprises a generally square-shaped member having width and length dimensions of about 2.5 to about 8 inches, more preferably width and length dimensions of about 3 to about 7 inches, and most preferably width and length dimensions of about 4 inches, for pints and quarts, and about 5 inches for a half gallon container. It is to be appreciated that both the width and the length dimensions of the pressure pad can vary, from application to application, depending upon the sealing equipment, the type and size of the carton to be formed, etc. The primary use of the pressure pad, according to the present invention, is to seal the bottom of paperboard 8 oz. cartons, pints, quarts, half gallons, etc. as well as other sized containers of milk, juice, ice tea, other liquids and powders.

The pressure pad 102, of FIGS. 3A and 3B for forming quart containers, has a multi level top surface 101 which has a variety of sealing components having planar surfaces lying in at least three distinct planes, i.e. an upper first plane 103, an intermediate second plane 104 and a lower third plane 105 (FIG. 3B). These three planes 103, 104, 105 generate a distinct layering effect and create an overall 3-dimensional topographical configuration on the top surface 101 of the pressure pad 102.

Each of the three planes 103, 104, 105 delineates a number of different shapes and features which are designed to facilitate proper sealing of a particular associated carton seam, joint and/or breach created by the above described closing and folding of the lower panels on the bottom of the gable container. The three planes 103, 104, 105 are segregated by a plurality of perpendicularly extending vertical walls interconnected directly to the horizontal planar surfaces forming the top surface 101, and the intersection of the vertical walls with the horizontal planar surfaces result in edges which, with the horizontal planar surfaces, create the particular areas of stress that seal a particular associated carton seam, edge and/or breach. If desired, a small chamfer may be provided at the intersection of the vertical walls with the horizontal planar surfaces.

It is to be appreciated that the planar surfaces forming the areas of protrusion and relief, as well as the recesses and the projection elements, can be formed by any conventional methods known in the art, including milling, cutting, welding etc., as such methods are well known in the art, a further detail discussion of the same is not provided herein. The following description assumes the order in which the features would normally be formed based upon conventional milling and template methods. This description is utilized for ease of understanding the invention, although it is conceivable that the described elements and/or features may be formed in another order or by a differing manufacturing process.

Figure 4:
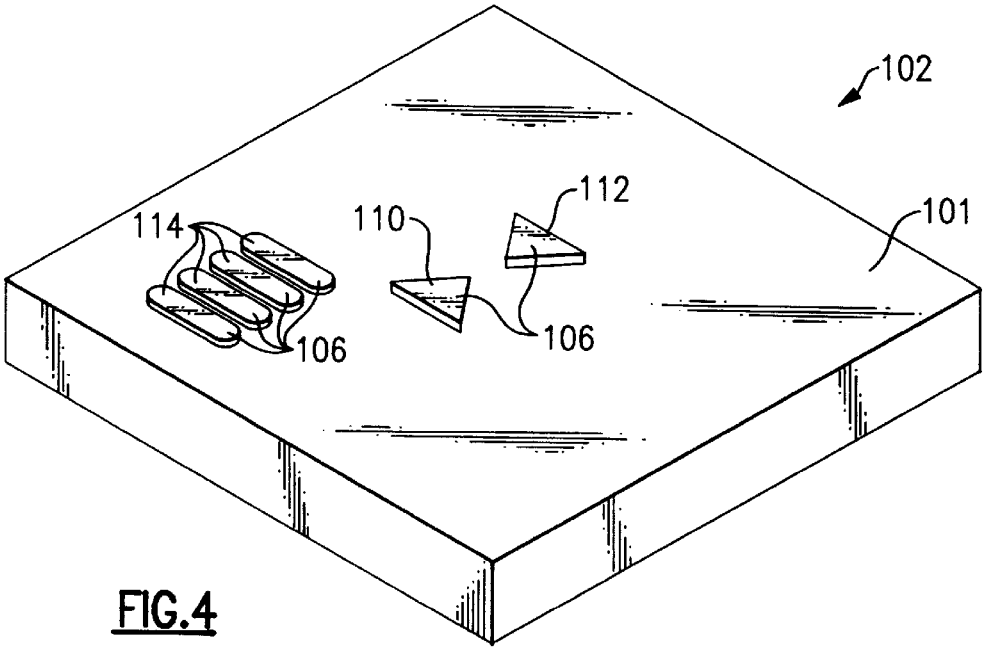
FIG. 4 is a diagrammatic perspective view of a pressure pad which show the components which lie in a first upper plane.

The top surface 101 of the pressure pad 102 is initially formed into rectangular or square solid block of a desired metal, e.g. stainless steel, steel, aluminum, etc. As shown in FIGS. 3A and 4, the components which lie in the upper first plane 103 are first formed in the solid metal block by removing unwanted material so that the desired components, which have a horizontal planar surface lying in the upper first plane 103, remain. According to the first embodiment of the present invention, the unwanted material is removed to leave opposed first and second chevrons 110 and 112, respectively, in the central portion of the solid metal block and a plurality of parallel extending elongate tracks 114, commonly referred to as railroad tracks, located in one quadrant (the top left quadrant of FIG. 3A) of the pressure pad 102. As can be seen in FIGS. 3A and 4, four parallel rectangular or narrow oval extending elongate tracks 114 are shown in this drawing. It is to be appreciated that the number, length, shape, spacing, etc., of the tracks 114 can vary, from application to application, depending upon the specific design requirements for the carton bottom to be sealed. As such teaching is well known in the art, a further detailed description of the same is not provided.

The specific shape and placement of the chevrons 110, 112 and the tracks 114 are a fairly important feature in order to ensure proper sealing of the fold closed bottom end of the carton by the pressure pad 102 according to the present invention. The chevrons 110, 112 have a substantially triangular shape transverse cross section, or trapezoidal and extend above the intermediate plane 104 a distance of about 0.014 inch to about 0.015 inch, or so. It is to be appreciated that the distance that these components extend above the intermediate plane 104 is directly dependent upon the type and thickness of the paperboard used in forming the container and this distance must be controlled in order to prevent "burn through" of the paperboard. As the determination of a suitable distance that the components will extend above the intermediate plane 104, to avoid burn through, is conventional and well known to those skilled in the art, a further detail discussion concerning the same is not provided.

Figure 2:
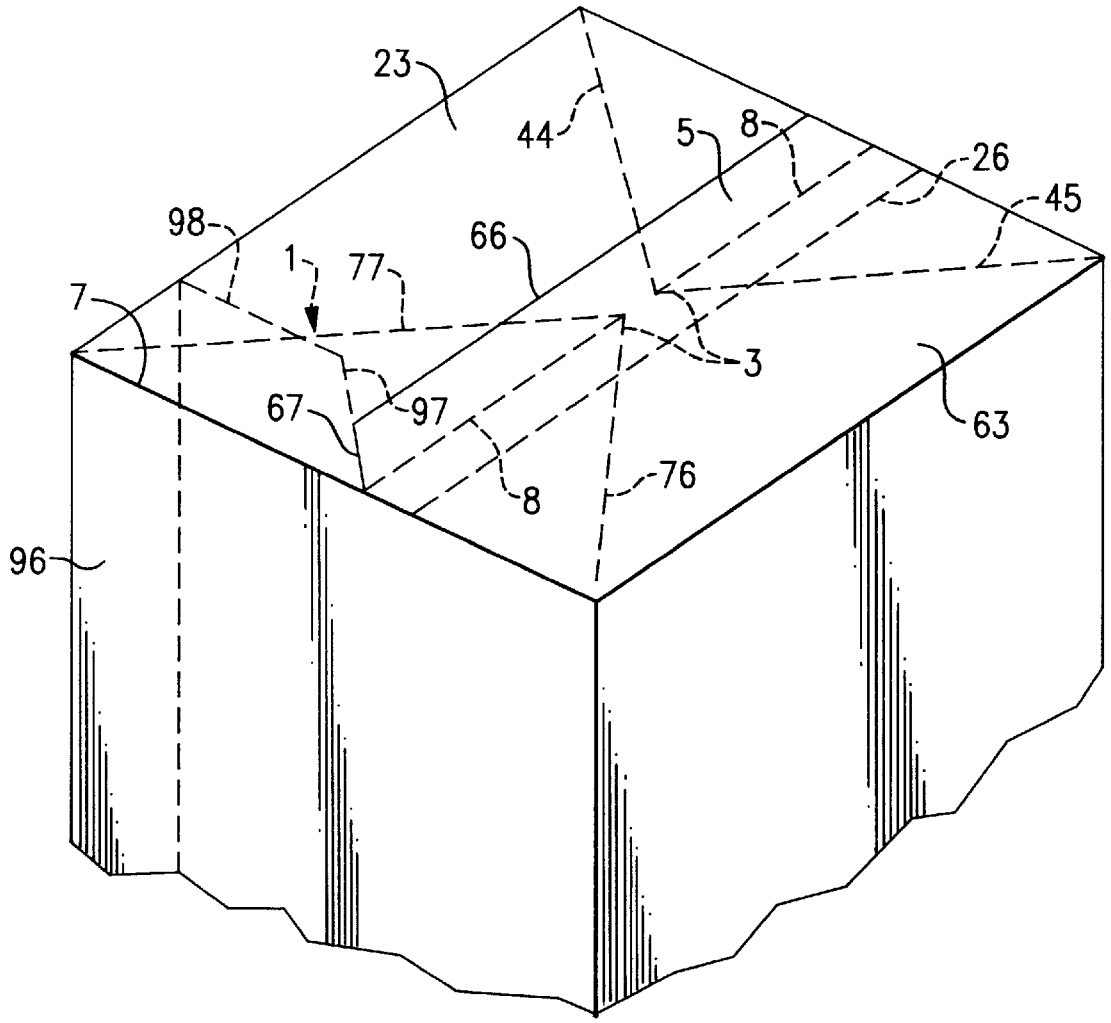
FIG. 2 is a partial diagrammatic perspective view of a base of a complete folded container bottom, of the half gallon paperboard blank of FIG. 1, detailing both visible and hidden edges and seams created by folding of the paperboard blank.
Figure 2A:
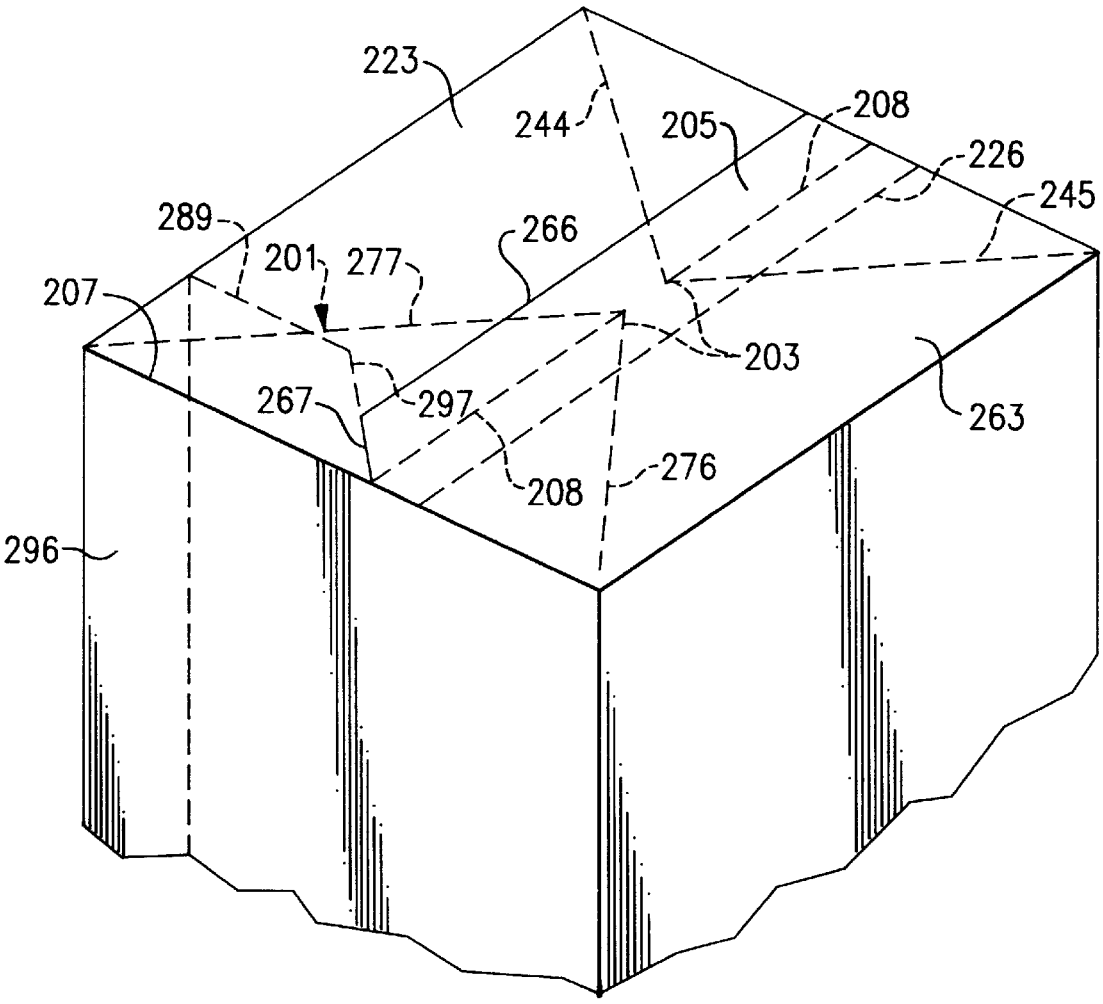
FIG. 2A is a partial diagrammatic perspective view of a base of a complete folded container bottom, of the quart paperboard blank of FIG. 1A, detailing both visible and hidden edges and seams created by folding of the paperboard blank.

The chevrons 110, 112 are located substantially centrally and are positioned opposed to one another on the top surface 101 of the pressure pad 102, as seen in FIG. 4. The chevrons 110, 112 are generally acute triangles with the apex of each of these two acute triangles, or smaller surface of the trapezoid, pointing towards one another and being spaced from one another by a distance of about 5/16 of an inch to about ½ inch. Each of the two chevrons 110, 112 is designed to mate substantially with the fold lines 244 or 245 and 277 or 276 of the bottom panels 243 and 275 of the quart blank 210. Specifically, the chevrons 110, 112 are formed so as to be aligned at a 90 degree offset with the apex 203 of the folded triangular bottom panels 243 and 275 disposed on the interior of the container, as shown in FIG. 2A—and seal the overlapped bottom wall panels 223, 263 to one another. Thus, the chevrons 110, 112 create an area of stress upon a triangular shaped area of the overlapped bottom wall panels 223, 263, adjacent the apex 203 of adjacent fold lines 276, 277 and 245, 244, and seal the overlapped bottom panels 263, 223 of the container with one another.

The folded triangular bottom panels 275, 243 create critical areas for proper sealing of a container as it is in the central area of the container bottom, substantially proximate the apex 203, that a number of layers of paperboard are compressed and must be completely fused together without any burn through occurring. Burn through typically results when excess stress or pressure is established on a particular area of the container by the pressure pad 102 thereby compromising the integrity of the container. Such stress can be caused by misalignment of the pressure pad 102 with the container bottom, use of an improper pressure pad for a particular type of paper, or for other reasons well known in the art.

The paperboard material tends to bunch at the apex 203 of the folded triangular bottom panels 275, 243 creating potential points and/or areas of leakage from the apex 203 and along the triangular panel seams 208. These areas require a significant stress to properly seal them, however, any misalignment or incompatible paperboard may cause the pressure pad to tear or burn through the thinner layers or areas of the carton bottom.

Figure 1:
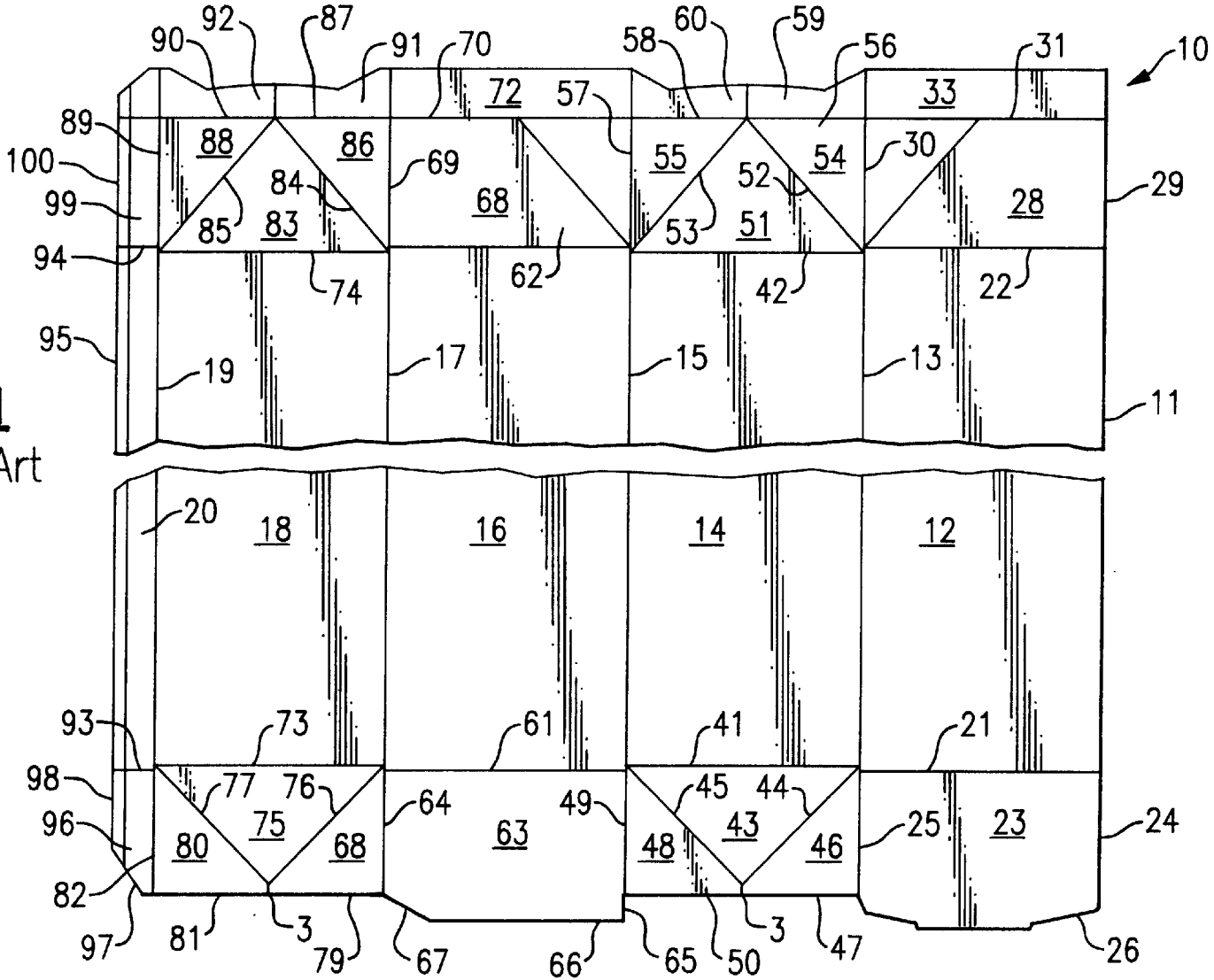
FIG.1 Prior Art
FIG. 1 illustrates a paperboard half gallon blank with appropriate score and fold lines for forming a conventional paperboard half gallon gabled container.
Figure 1A:
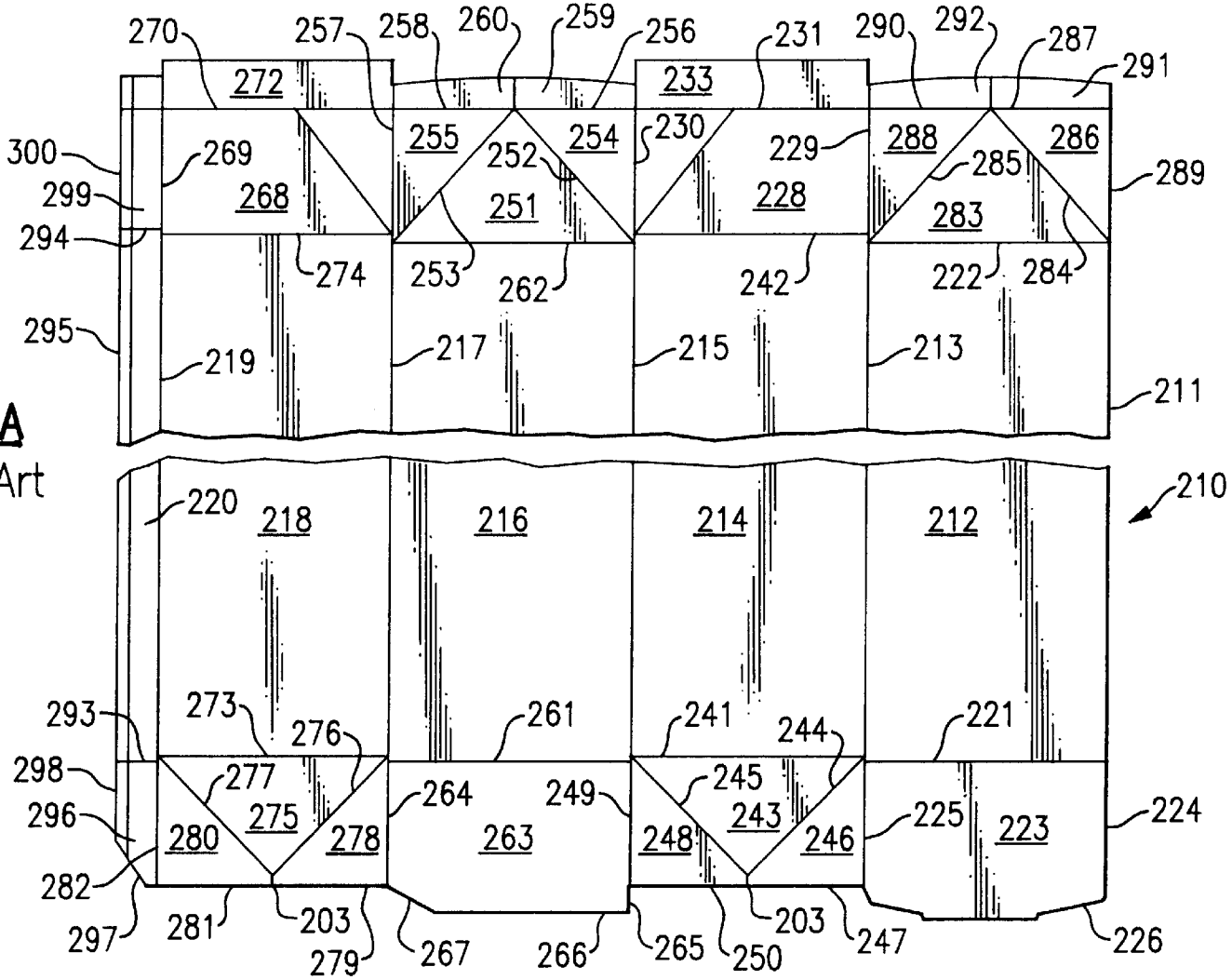
FIG.1A Prior Art
FIG. 1A illustrates a paperboard quart blank with appropriate score and fold lines for forming a conventional paperboard quart gabled container.

The glue panel 296, as shown in FIG. 1A, facilitates the formation of the unsealed container tube from the paperboard blank. As shown in FIG. 2A, the glue panel 296 continues as a seam extending along container bottom panel 223 and is accordingly folded along with the bottom panels to create not only a raw edge 207 and seam along a bottom edge of the container but also an intersecting area 201 with the triangular fold line 277 of the folded triangular bottom panel 275. This intersecting area 201 is another potential area of leakage or failure for the container bottom.

The tracks 114 create a number of separate transverse sealing members extending generally perpendicular to and along the bottom edge of the container and substantially positioned to contact the glue panel 296 and, in particular, the intersecting area 201 and adjacent area along raw edge 289. The tracks 114 are located to influence the paperboard, where the glue panel 296 contacts the adjacent fold line 277 of the triangular folded bottom panel 275, and create the intersecting area 201, as seen in FIG. 2A. The intersecting area 201 has the potential for failure, due to the overlap of at least four layers of paperboard, i.e. the folded web 280, the bottom panel 275, the glue panel 296, and the bottom panel 223. Because of the overlap of four layers of paperboard in close proximity to several critical seams, namely, the glue panel 296 and bottom edge seam 207, the tracks 114 provide the necessary sealing to prevent leakage or breach of this area.

The tracks 114 create a series of substantially rectangular depressions in the carton bottom further sealing the glue seam seal 296. The tracks may, as with the chevrons 110, 112, be formed at least in part with a further lower planar area, as will be discussed below, thus designating a need for a second vertical wall between such a lower planar area and the surface of the track. This will tend to create in effect a deeper edge along at least a portion of each of the tracks. The deeper edge is necessary to provide a more penetrating depression along a greater number of folds in certain portions of the folded bottom panels which are described more fully below.

The top planar surfaces 106 of the tracks 114 and chevrons 110, 112, which lie in the first plane 103, provide the most aggressive fusing of the above described critical carton bottom portions, as it is these areas which are the most prone to failure and leakage.

Another critical area of the container bottom, in need of a proper seal, is the transverse seam 205 created by the overlapped bottom panels 223 and 263, as can be seen best in FIG. 2A. The overlapped bottom panels 223, 263 create a wide transverse seam 205 formed by a portion of their edges which overlap one another by a distance of about ¼ to ¾ inch or so. Exterior bottom panel edge 266 may also include an angled edge 267. The angled edge 267, as seen in FIG. 2A, is the most apparent edge in the bottom of the container and is easily observed as being substantially centrally located and extending transverse to the generally square shape of the bottom of the container. This transverse seam 205 could be linear or composed of any number of sloped, angled or curved seams well known in the art.

Figure 5:
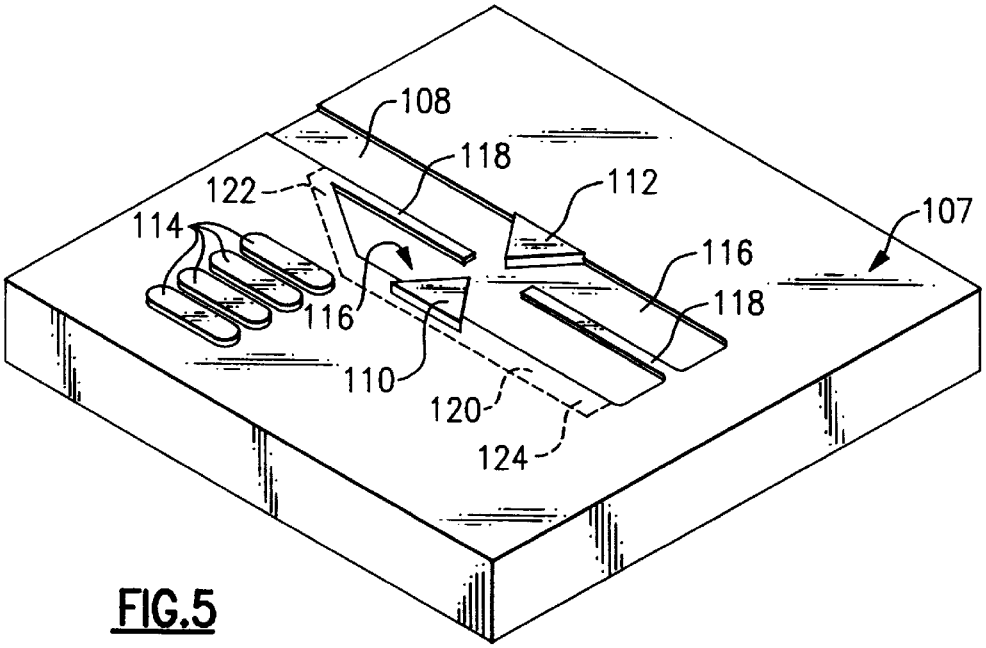
FIG. 5 is a diagrammatic perspective view of a transverse seam recess being provided in the pressure pad.

With reference to FIG. 5, a transverse seam recess 116 will now be described. The transverse seam recess 116 is milled or otherwise formed into the intermediate surface 107 of the pressure pad 102 to remove additional material therefrom and create a lower surface 108 lying in the lower third plane 105, i.e. an area of relief located below the level of the intermediate plane 104. During formation of the transverse seam recess 116, material is removed to leave a pair of first or central sealing legs 118, having planar surfaces lying in the intermediate plane 104, within the transverse seam recess 116. The two narrow central sealing legs 118 extend inwardly from the outer periphery of the pressure pad 102 toward the area located between the two chevrons 110, 112 of the pressure pad 102. Both of these two sealing legs 118 are axially aligned with one another but are spaced from one another by a small distance, e.g. about 11/16 of an inch or so. Each of these two sealing legs 118 has a width dimension of about 1/32 of an inch and a length dimension of about 11/16 of an inch to 1 inch or more. These two sealing legs 118 cooperate with a pair of dam pits, discussed below in further detail, to facilitate proper sealing of the perimeter edge 226 of bottom panel 223 with an intermediate inwardly facing surface of bottom panel 263 to provide a first seal between those two overlapped bottom panels 223, 263. In addition, a perimeter portion 120, e.g. a 1/16 to about an 1/8 of an inch or so, shown in dashed lines in FIG. 5, of the transverse seam recess 116, located adjacent chevron 110, also provides a second seal between the exterior edges 266, 267 of the bottom panel 263 with an outwardly facing surface of the bottom panel 223

The exterior bottom edge 266 and the angle edge 267 are both raw edges prone to wicking. The perimeter portion 120 has an angled region 122 and a transverse region 124, extending parallel to the two sealing legs 118, which regions are located to register with the exterior and the angled edges 266, 267 of the bottom panel 223 and provide a second proper seal between the two overlapped bottom panels 223, 263, i.e. the perimeter edges 266, 267 of bottom panel 263 are sealed with an intermediate outwardly facing surface of bottom panel 223. By this arrangement, a substantial portion of the overlapping bottom panels 223, 263 are sealed with one another by two somewhat parallel extending, spaced apart seams which further minimize the ability of moisture to wick into or fluid to leak out of the container past these two overlapped and sealed panels. This sloping edge 267 is necessary to accommodate an end of the glue panel 296 having a mating sloping edge 297, see FIG. 2A, in order to avoid the overlap of five pieces of paper.

Figure 6:
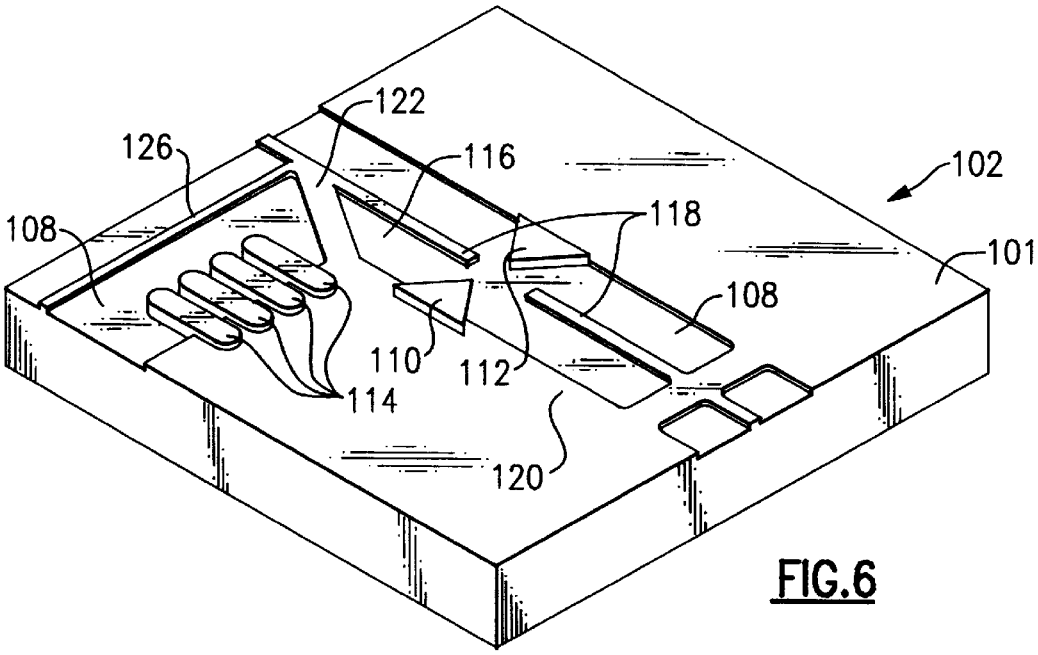
FIG. 6 is a diagrammatic perspective view showing formation of a third transverse sealing leg in the pressure pad.

Turning now to FIG. 6, a side edge sealing leg 126, having a top surface lying within the intermediate plane 104, is formed by relieving or removing additional material from the intermediate surface 107 of the pressure pad 102 to the level of the lower surface 108. The area on either side of the side edge sealing leg 126 is preferably removed to the level of lower third plane 105. This side edge sealing leg 126 has a length of about 2–2.5 inches and a width dimension of about 0.688 of an inch or so (depending upon the size of the container to be sealed) and is located to register with raw edge 224 of bottom panel 223 and seal, along with a dam pit 156 discussed below in further detail, the raw edge 224, the glue panel 296, the web panel 280, and a fourth panel 275 with one another. In addition, this area of relief also extends around and about a major portion of the tracks 114. This relief area allows the additional area to accommodate the overlapped sections of the paperboard.

Figure 7:
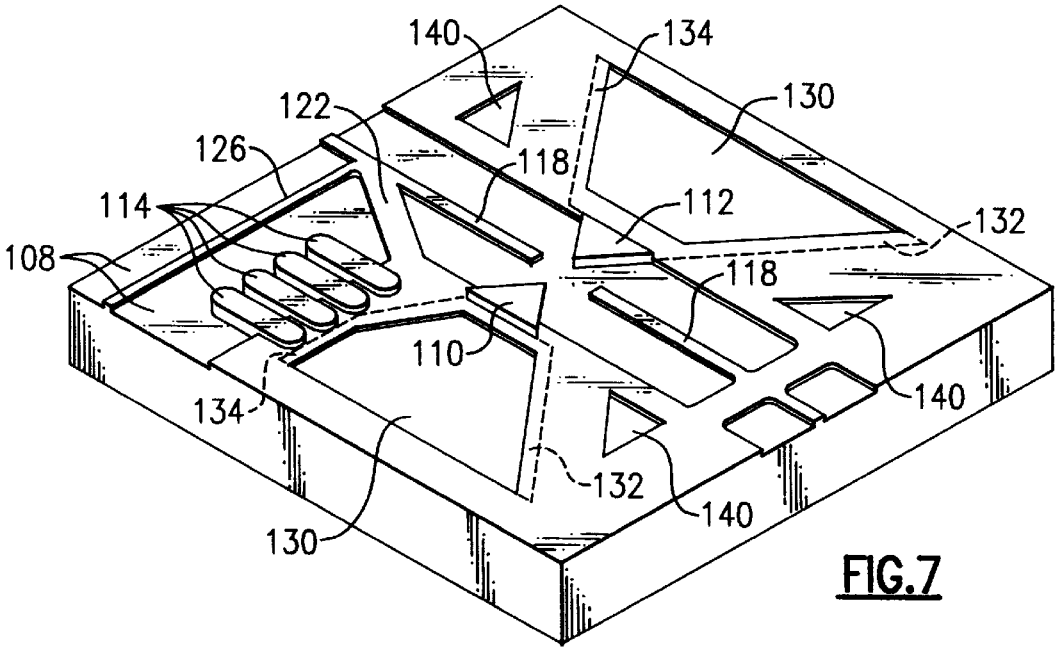
FIG. 7 is a diagrammatic perspective view showing the formation of a number of other recesses in the pressure pad.

With reference to FIG. 7, two other major areas of relief 130, in the form of a pair of substantially trapezoidal shaped areas, are provided in the intermediate surface 107 of the pressure pad 102. These trapezoidal shaped relief areas 130 are preferably removed to the level of lower third plane 105. At least a portion of these trapezoidal shaped relief areas 130 form what is known in the industry as a "bow tie" configuration. A perimeter portion of two inclined legs 132, 134 of each trapezoidal shaped relief area 130 lying within the intermediate plane 104, e.g. a 1/16 to about an 1/4 of an inch or so of the perimeter of pad defining each inclined leg and shown in dashed lines in FIG. 7, of the two trapezoidal shaped areas 130 facilitate sealing of the scored folds 276, 277 and 243, 244 of the triangular panels as they are folded against the bottom panels 223 and 263. That is, the inclined legs 132 of each trapezoid shaped area 130 coincide with the score lines 245, 276 of bottom panels 243, 275 while the inclined legs 134 of each trapezoidal shape area 130 coincide with the score lines 244, 277 of bottom panels 243, 275. These score lines create the inner triangular web panels along the associated scorings and facilitate the sealing of the remaining edges of these triangular panels folded within the container to the overlapped bottom panels 223, 263.

In addition, further areas of relief are provided, at various locations on the top surface of the pressure pad in the form of smaller triangular areas, e.g. three smaller minor triangular relief areas 140 are shown in FIG. 7. These minor triangular relief areas 140 are necessary in order to create greater sealing proficiency of the interior triangular bottom panels 243 and 275 with the overlapping bottom panels 223 and 263. The minor triangular relief areas 140, as can be seen in FIG. 7, are recessed to a surface 108 lying within the lower third plane 105. These minor triangular relief areas 140 are located so as to be aligned generally adjacent and co-angularly with the acute angles defined by the score lines 276 and 277 on the triangular bottom panel 275 as well as with the acute angles defined by the score lines 244 and 245 on bottom panel 243.

A perimeter of the smaller minor triangular relief areas 140 influence a substantially complete triangular seal of a substantial portion of each side of the bottom panels 275 and 243 by creating a significant increase in stress in the regions of the folded triangular inner bottom panels 275 and 243 which are not within the areas of relief. It should also be noted that these minor triangular relief areas 140 may be have a depth equal to that of the lower surface 108 or may of somewhat of a greater or lesser depth, thereby creating another planar level in the top surface 101 of the pressure pad 102.

Figure 8:
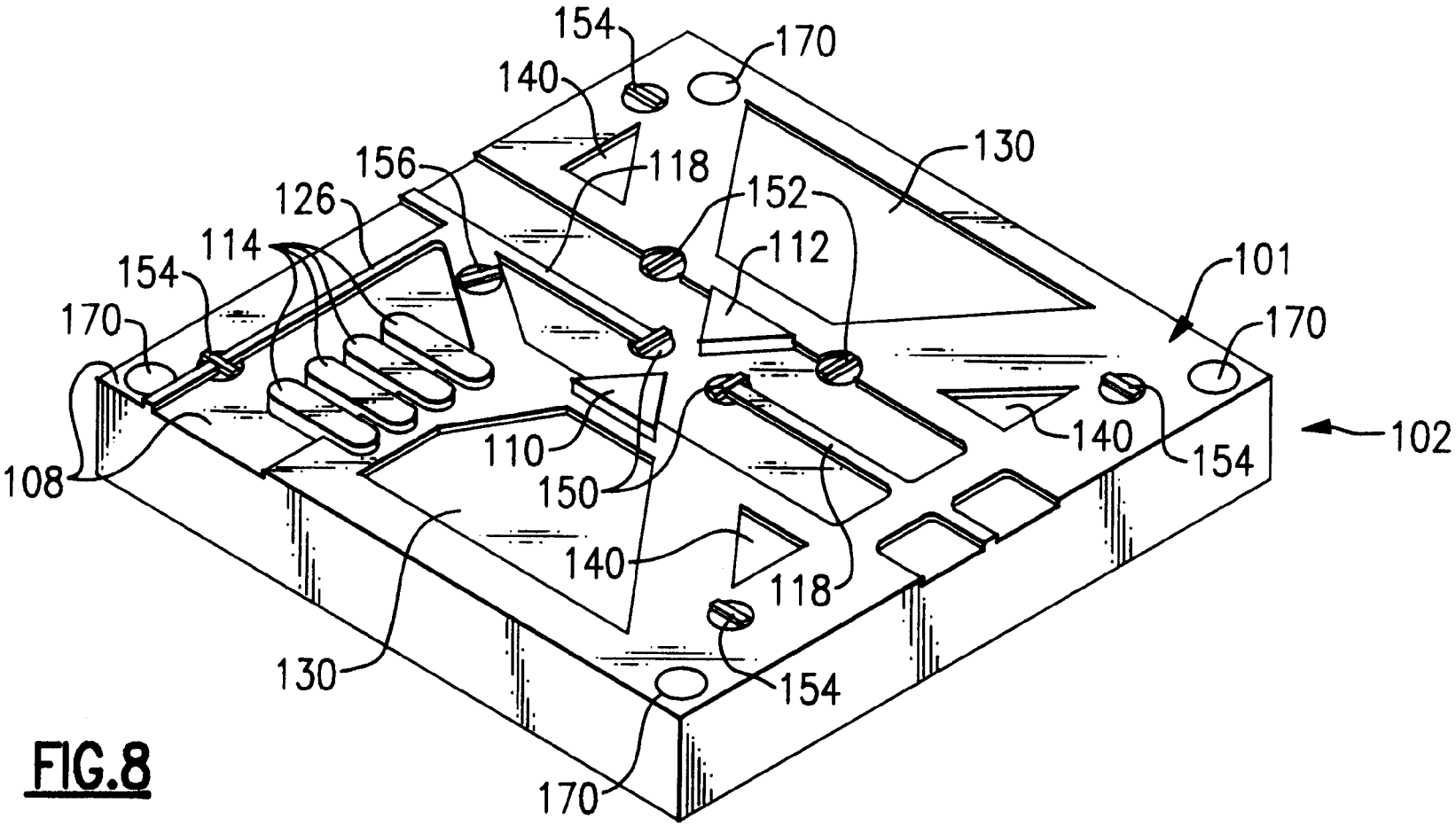
FIG. 8 a diagrammatic perspective view showing the various types and locations of the dam pits which provide intense areas of sealing.

Turning now to FIG. 8, besides the feature described above, there are a number of projections called dam pits 150, 152, 154, 156 and 158 which project from the pressure pad 102 to the level of the upper first plane 103. The dam pits are received within an unthreaded larger diameter bore, formed in the top surface 101 of the pressure pad 102, and the dam pits have a very slight interference fit, e.g. a few thousands of an inch or so, with the bore to facilitate retaining the dam pit within the respective bore at a desired orientation. A lower portion of the bore, remote from the top surface 101, is threaded and receives a matingly threaded set screw (not shown) which facilitates minor height adjustment of the dam pit within the bore. Each of the dam pits 150, 152, 154, 156 and 158 are important because they further contribute to sealing of the critical portions of the seams created by folding the bottom panels of the container.

There are four (4) critical central dam pits arranged in a generally trapezoidal configuration, as can be seen in FIG. 8. The four (4) dam pits consist of an inner pair of dam pits 150, located adjacent chevrons 110 and 112, and an outer pair of dam pits 152 located adjacent chevron 112. The elongate rectangular dam pit sealing surface of each of these four dam pits 150, 152 are aligned parallel with one another. The inner pair of dam pits 150 are located at the adjacent ends of each one of the two sealing legs 118 and serve the function of providing further sealing pressure to each of the overlapped bottom panels 223, 263, as seen in FIG. 2A. Each dam pit 150 is located substantially adjacent the apex 203 of one of the triangular bottom panels 275 and 243 and further guards against the bunching, as previously described.

The outer pair of dam pits 152 are arranged directly at the intersections of score lines 277 and 244 with edge 266 of bottom panel 263. This seal is deemed a critical one because it is in contact with the outer most bottom panel and thereby such a seam could provide a potential greater area of leakage. These four dam pits 150, 152 are located in a position to further enhance the sealing capability of the pressure pad 102, according to the present invention.

There are also four (4) dam pits 154, with there elongate rectangular dam pit sealing surface being aligned parallel with one another, located about the periphery of the pressure pad. Each one of the four (4) parallelly aligned dam pits 154 is arranged substantially parallel to a longitudinal direction of the tracks 114 and is located to engage with and the seal periphery, i.e. at least one of the edges 224, 225, 249, 264, and 282 of the base of the container to be formed.

Lastly, a single dam pit 156 is located along the angled region 122. This dam pit 156 is aligned perpendicular to the longitudinal direction of the angled region 122 and the dam pit 156 facilitates sealing the angled edge 267 of the bottom panel 263 with the outwardly facing overlapped bottom panel 223.

Each one of the dam pits 150, 152, 154, and 156 comprises a cylindrical member which has an interference fit with a respective bore formed in the top surface 101 of the pressure pad 102 at suitable locations. Each dam pit has a rectangular shaped sealing surface or bar formed in a top surface thereof that has a width dimension of about 1/16 of an inch or so and a length dimension of about 3/16 of an inch or so. It is to be appreciated that the width and length dimensions of the sealing bar of the dam pit can vary from application to application.

A set screw is provided with an exterior thread which is sized to mate with an interior thread formed in the threaded portion of the bore of the pressure pad 102. The threaded engagement between the external thread of the set screw and the internal thread of the bore of the pressure pad facilitates adjustment of the height of the dam pit located within the respective bore to maintain the top surface of sealing bar of the dam pit at a desired level. Such height adjustment feature compensates for wear of the to surface of the sealing bar of the dam pit from use of the pressure pad 102. It is to be appreciated that the thread carried by the set screw as well as the mating thread carried by the bore of the pressure pad should be a relatively fine thread to allow slight incremental adjustment in the height of the top surface of the sealing bar of the dam pit relative to a remainder of the pressure pad 102.

A plurality of attachment apertures 170, e.g. four, are provided in the top surface 101 of the pressure pad 102 for securing the pressure pad 102 to desired press equipment. As the size and location of such attachment apertures 170 are conventional and well known in this art, a further detail description concerning the same in not provided.

Figure 9:
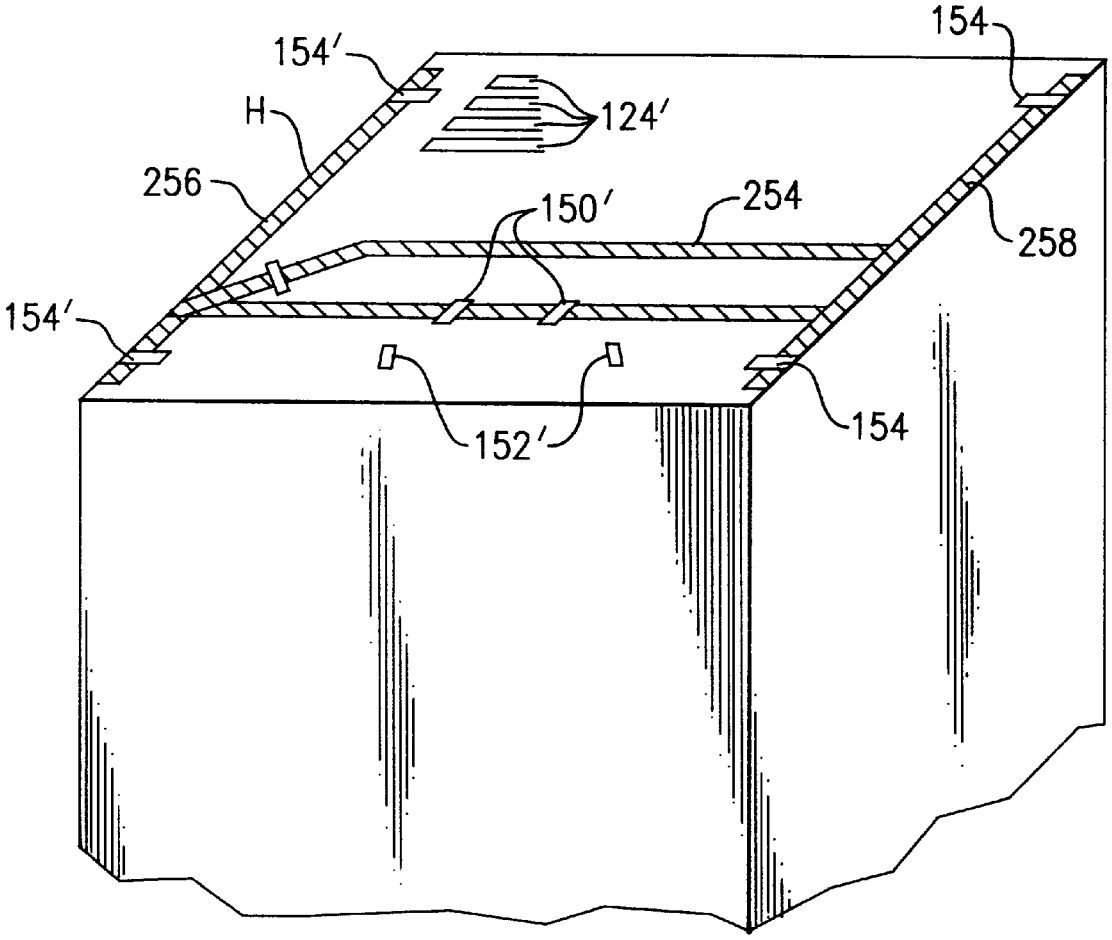
FIG. 9 is a diagrammatic bottom plan view of the base of a quart carton manufactured with the pressure pad according to the first embodiment of the present invention.

With reference to FIG. 9, the base of a carton, sealed via the pressure pad according to the first embodiment of the present invention, can be seen. As shown in this Figure, the intermediate and two opposed edge surfaces of the pressure pad 102 along with six dam pits 150, 154 form a generally H-shaped impression H (shown as hatched lines) in the base of the formed container. That is, the two inner dam pits 150 along with the two sealing legs 118 form a first transverse section 252 of the H-shaped seal while the angle region 122 and the transverse region 124 form a second transverse section 254 of the H-shaped seal. In addition, the two opposed end regions of the intermediate surface of the pressure pad 102, extending between each adjacent pair of dam pits 154 located along an edge of the pressure pad, form edge seals 256, 258 which seal the edges 224, 225, 249, 264 and 282 on the base of the container. These two pairs of edge seals 256, 258 extend substantially parallel to one another and are substantially contiguous with the end regions of the first and the second transverse sections 252, 254 of the H-shaped seal to complete formation of the generally H-shaped impression in the base of the formed container. The impressions formed by the dam pits 150, 152 and 154 are shown in this Figure as indentations 150', 152' and 154', respectively.

Figure 10A:
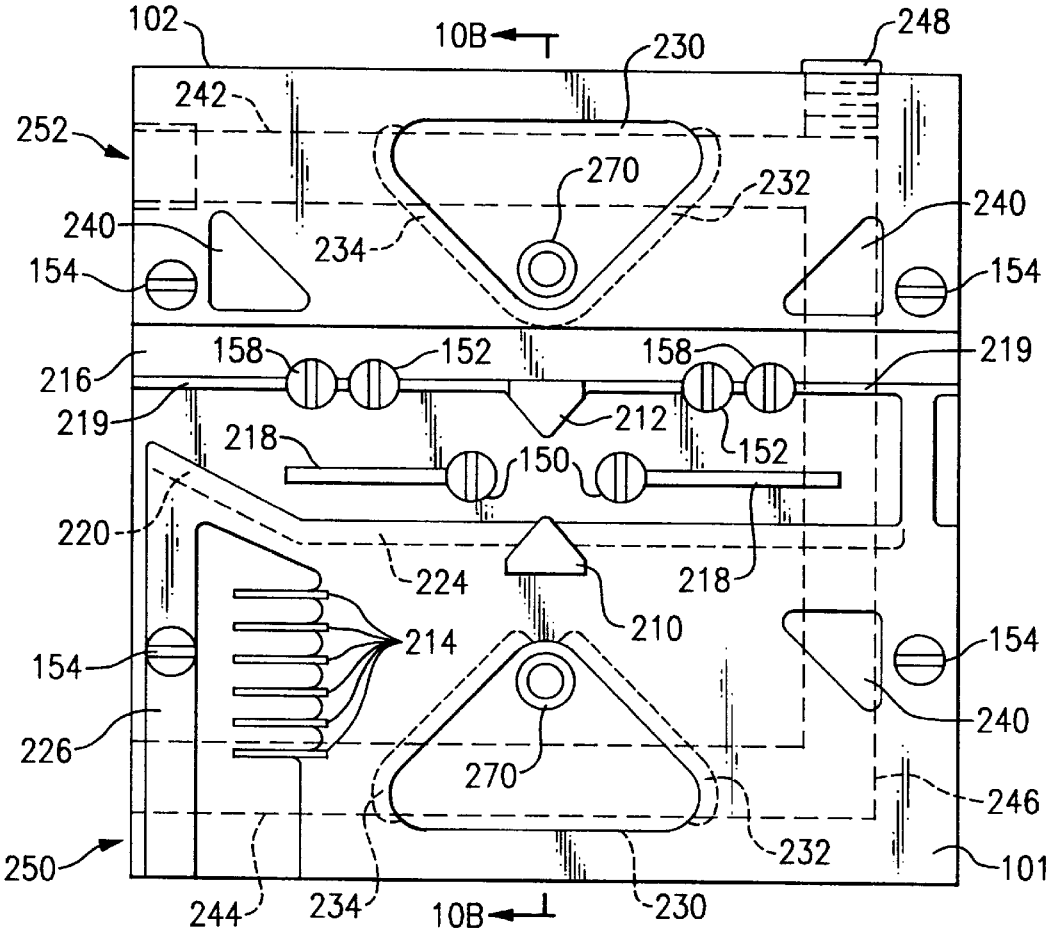
FIG. 10A is a diagrammatic top plan view of an improved half gallon pressure pad according to the present invention.
Figure 10B:
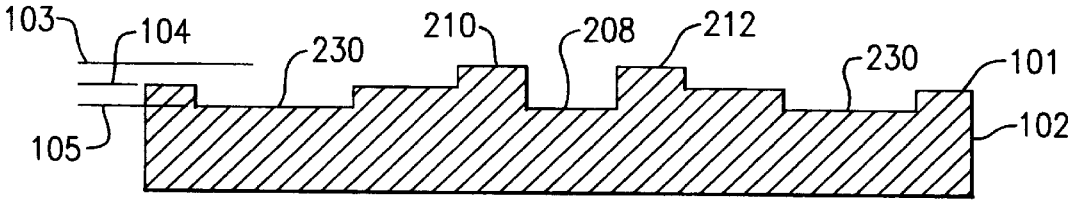
FIG. 10B is diagrammatic cross sectional view along section line 10B—10B of FIG. 10A.

With reference FIGS. 10A and 10B, a second embodiment of the present invention will now be discussed for seal half gallon blanks. As this embodiment is very similar to the first embodiment, only differences between the second embodiment and the first embodiment will be discussed in detail.

One major difference between the first embodiment and the second embodiment is the size of the dam pits. The dam pits, according to the second embodiment, have length dimension of about 0.390 inch and a width dimension of about 0.187 inch. Secondly, the single dam pit 156, located along the angled region 122, is eliminated in the second embodiment while a further pair of dam pits 158 is utilized. A first one of this further pair of dam pits 158 is located adjacent to but spaced slightly, e.g. 0.312 inch or so, from one of the outer dam pits 152 while a second one of this further pair of dam pits 158 is located adjacent to but spaced slightly from the other outer dam pits 152. Each one of the these additional dam pits 158 is located between the outer dam pit 152 and the outer edge of the pressure pad 102.

According to the second embodiment, the transverse cross-section of the chevrons 210, 212 are still located substantially centrally and they are positioned opposite one another on the top surface 101 of the pressure pad 102. The shape of the chevrons 210, 212 are slightly modified, from the shape of the first embodiment, and are generally formed in the shape of pentagon or "home plate" with an apex of each chevron 210, 212 pointing toward one another but are spaced from one another by a distance of about 0.245 inch to about 0.250 inch or so.

In the second embodiment, two additional tracks 214 are utilized, e.g. there are six tracks 214 instead of four tracks, and each track 214 is slightly narrower and longer than the tracks of the first embodiment, e.g. each track has a width of about 0.310 inch and a length of about 0.438 inch. Further, a second transverse seam recess 216, extending from adjacent one side edge of the pressure pad 102 to adjacent the other side edge of the pressure pad 102, is formed in the intermediate surface 107 of the pressure pad 102 at a location immediately behind the chevron 12. The second transverse seam recess 216 extends to a level of the third plane 105. This arrangement results in a second pair of sealing legs 219. The second pair of sealing legs 219 are aligned with one another and also with four (4) dam pits 152, 158. Each leg, of the second pair of sealing legs 218, has a width dimension of about 0.255 inch. The second pair of sealing legs 219 cooperate with the two pair of dam pits 152, 158 and the chevron 212 to facilitate proper sealing of the perimeter of edge 26 of the bottom panel 23 with an intermediate outwardly facing surface of the bottom panel 63 to provide a second seal between those two overlapped bottom panels 23, 63.

A first or central pair of sealing legs 218, according to the present invention, are aligned in a substantially centered position between the two chevrons 210, 212. The first pair of central sealing legs 218, having planar surfaces lying in the intermediate plane 104, within the transverse seam recess 116. Each central sealing leg 218 extends inwardly from the outer periphery of the pressure pad 102 toward the area between the two chevrons 210, 212 of the pressure pad 102. Both of these two sealing legs 218 are aligned with one another but are space from one another by a small distance, e.g. about 11/16 of an inch or so. Each of these two sealing legs 218 has a width dimension of about 1/32 of an inch and a length dimension of about 11/16 of an inch to 1 inch or more. These two sealing legs 218 cooperate with a pair of dam pits 150 to facilitate proper sealing of the perimeter edge 26 of bottom panel 23 with an intermediate inwardly facing surface of bottom panel 63 to provide a first seal between those two overlapped bottom panels 23, 63.

In addition, a perimeter portion 224, e.g. a 1/16 to about an 1/8 of an inch or so, shown in dashed lines in FIG. 10, of the transverse seam recess, located adjacent chevron 210, also provides a third seal between the exterior edges 66, 67 of the bottom panel 63 with an outwardly facing surface of the bottom panel 23.

Another difference between the second embodiment and the first embodiment, is the width of the side edge sealing leg 226. According to this embodiment, the transverse sealing leg has a width dimension of about 0.251 inch and is located to register with raw edge 24, bottom panel 23 and seal, along with dam pit 154, the raw edge 24, the glue panel 96, the web panel 80 and a fourth panel 75 with one another.

The two major triangular relief areas 230, according to the second embodiment, are generally triangular in shape and have a much wider perimeter area available for mating with and sealing the base of the container. According to this embodiment, a perimeter portion of two incline legs 232, 234 of the two major triangular relief areas 230, which lie in intermediate plane 104, facilitate sealing of the scored fold lines 76, 77 and 43, 44 of the triangle panels as they are folded against the bottom panels 23 and 63 within the container bottom.

As can be seen in FIG. 10, there are also three minor triangular relief areas 240, which are slightly larger in size in this embodiment than the size of the first embodiment. In all other respects, the three minor triangular relief areas 240 triangles are substantially identical in function to the previously described minor triangular relief areas 140.

Figure 11:
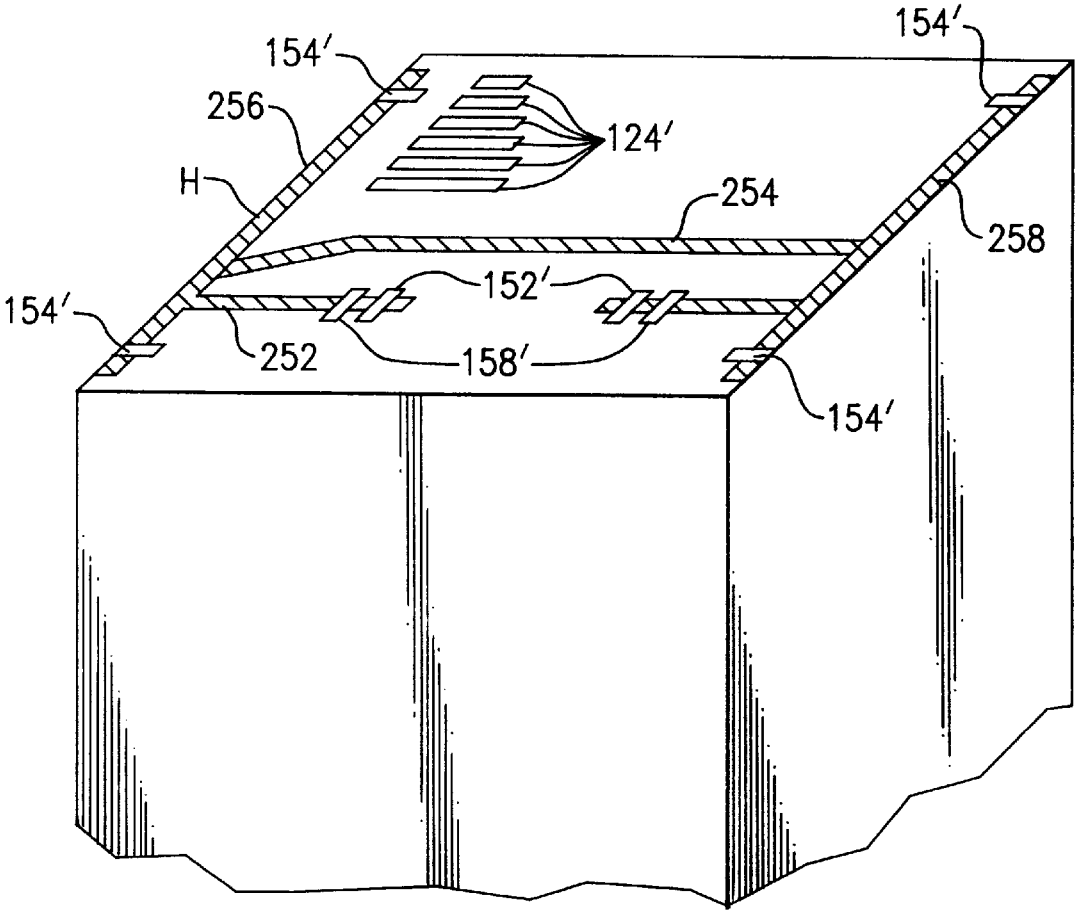
FIG. 11 is a partial diagrammatic bottom plan view of a base of a half gallon carton manufactured with the pressure pad according to the second embodiment of the present invention.

With reference to FIG. 11, the base of a carton, sealed via the pressure pad according to the second embodiment of the present invention, can be seen. As shown in this Figure, the intermediate and two opposed edge surfaces of the pressure pad 102 along with eight dam pits 150, 154 and 158 form a generally H-shaped impression H (shown as hatched lines) in the base of the formed container. That is, the two inner dam pits 152 and the two outer dam pits 158 along with the two second sealing legs 219 form a first transverse section 252 of the H-shaped seal while the angle region 222 and the transverse region 224 form a second transverse section 254 of the H-shaped seal.

In addition, the two opposed end regions of the intermediate surface of the pressure pad 102, extending between each adjacent pair of dam pits 154 located along opposed edges of the pressure pad, form edge seals 256, 258 which seal the edges 24, 25, 49, 64 and 82 on the base of the container. These two pairs of edge seals 256, 258 extend substantially parallel to one another and are substantially contiguous with the end regions of the first and the second sections 252, 254 of the transverse H-shaped seal to complete formation of the generally H-shaped impression in the base of the formed container. The impressions formed by the dam pits 150, 152, 154 and 158 are shown in this Figure as indentations 150', 152', 154' and 158', respectively.

In order to facilitate sufficient cooling of the pressure pad 102, during use, an interior U-shaped cooling conduit is formed within the pressure pad 102. This is achieved by drilling two parallel elongate bores 242, 244, from one side edge of the pressure pad a majority of the way through the pressure pad but not completely there through (see FIG. 10). A third elongate bore 246 is drilled in the pressure pad 102 so as to interconnect the two closed end of the two parallel extending bores 242, 244 with one another and thereby form a substantially U-shaped conduit within the pressure pad 102. The third bore also does not extend complete through the pressure pad, e.g. only a sufficient distance to interconnect the two closed end of the two parallel extending bores. The open end of the third bore is threaded and receives as threaded plug 248 to seal that opening. The resulting arrangement is a U-shaped conduit with the opening of one of the bores functioning as coolant supply inlet 250 and the opening of the other bore functioning as coolant removal outlet 250. As such cooling feature is conventional and well-known in the art, a further detailed discussion concerning the same is not provided.

The major difference between the pressure pads for the quart container versus that of the half gallon is that the pressure pad of the quart container has four railroad tracks while the pressure pad for the half gallon container has six railroad tracks. In addition, the dam pits for the quart container are generally 3/16 inch in length while the dam pits for the half gallon pressure pad are about 1/4 inch in length. Lastly, there are four mounting holes for mounting the quart pressure pad to conventional production equipment while there are only two holes 270 for mounting the half gallon pressure pad to the conventional equipment.

Since certain changes may be made in the above described pressure pad and method of sealing a gable carton with an improved pressure pad, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A pressure pad for sealing a base of a carton made from paperboard, the pressure pad comprising:

a top surface being generally flat and defining an intermediate plane of the pressure pad, the top surface of the pressure pad having a plurality of components extending from the top surface of the pressure pad and lying in a first plane, and the pressure pad having a plurality of components recessed into the top surface of the pressure pad and lying in a third plane, and at least the plurality of components which lie in the first and intermediate planes facilitate sealing of the base of the carton made from paperboard;

the pressure pad having a pair of opposed chevrons being located in a central portion of the top surface of the pressure pad, a set of parallel arranged railroad tracks, for engaging with a glue panel of the paperboard, being spaced from the pair of chevrons and located in a quadrant of the pressure pad, and a plurality of dam pits located to facilitate sealing of the base of the carton made from paperboard, and the pair of chevrons, the set of railroad tracks and the plurality of dam pits all extend from the top surface of the pressure pad and lie in the first plane; and a plurality of recesses formed in a top surface of the pressure pad, and the plurality of recesses each having a planar surface lying in the third plane and the plurality recesses formed in a top surface of the pressure pad provide areas which relieve pressure and prevent burn-out during sealing of the base of the carton made from paperboard.

2. The pressure pad according to claim 1, wherein the pressure pad includes a pair of sealing legs which extend inwardly from a side edge portion of the sealing pad toward a central portion of the sealing pad, and the sealing legs are located between the pair of chevrons.

3. The pressure pad according to claim 2, wherein a dam pit is located adjacent a central most end of each one of the sealing legs and the dam pits located adjacent a central most end of each one of the sealing legs are spaced from one another.

4. The pressure pad according to claim 1, wherein at least four railroad tracks are provided on the pressure pad and the at least four railroad tracks are arranged parallel to one another for engaging with a glued panel of the paperboard and facilitate proper sealing thereof during operation of the pressure pad.

5. The pressure pad according to claim 1, wherein a pair of major relief areas are provided in the top surface of the pressure pad, one of the pair of major relief areas is located between one of the pair of chevrons and an outer edge portion of the pressure pad, and the other of the pair of major relief areas is located between the other of the pair of chevron and an opposite outer edge portion of the pressure pad, and a base of the pair of the major relief areas lie in the third plane.

6. The pressure pad according to claim 5, wherein at least three minor triangular shaped relief areas are provided in the pressure pad adjacent the pair of major relief areas, and a base of the at least three minor triangular shaped relief areas lie in the third plane.

7. The pressure pad according to claim 1, wherein a portion of the pressure pad lying within the intermediate plane has a transverse region, extending parallel to the sealing legs and an angled region which are both located to engage and seal raw edges of a base of the carton made from paperboard to be sealed by the pressure pad during operation of the pressure pad.

8. The pressure pad according to claim 7, wherein a side sealing edge is provided which extends along a side edge portion of the pressure pad, adjacent at least four railroad tracks, and the side sealing edge is contiguous with the angled region and the transverse region of the pressure pad.

9. The pressure pad according to claim 8, wherein a dam pit is located along the side sealing leg and the dam pit has a sealing bar which extends above a surface of the side edge sealing leg and lies in the first plane.

10. The pressure pad according to claim 8, wherein the pressure pad includes at least two holes therein to facilitate securing of the pressure pad to desired manufacturing equipment, and the pressure pad is provided with an internal conduit which extends through an interior of the pressure pad to facilitate cooling of the pressure pad during operation of the pressure pad.

11. The pressure pad according to claim 1, wherein each of the pair of opposed chevrons has a substantially triangular shaped transversed cross-section.

12. The pressure pad according to claim 8, wherein a second pair of opposed sealing legs extend from an outer edge portion of the pressure pad toward at least one of the pair of chevrons, in each of the second pair of opposed sealing legs is provided with at least two dam pits to facilitate sealing of a desired portion of a base of the carton made from paperboard.

13. The pressure pad according to claim 1, wherein a second transverse seam recess extends from adjacent one side edge portion of the pressure pad to adjacent the opposite side edge portion of the pressure pad, and the second pair of sealing legs is located between a first transverse seam recess and a second transverse recess.

14. The pressure pad according to claim 1, wherein the second pair of sealing legs both extend to and abut with opposite sides of one of the pair of chevrons, and the second pair of sealing legs lie within the intermediate plane.

15. The pressure pad according to claim 1, wherein six railroad tracks are provided on the pressure pad and the six railroad tracks are arranged parallel to one another for engaging with a glued panel of the base of the carton made from paperboard to be sealed.

16. The pressure pad according to claim 15, wherein the pressure pad includes at least four holes in a perimeter thereof to facilitate securing of the pressure pad to desired manufacturing equipment, and the pressure pad is provided with at least one conduit, extending through the pressure pad, to facilitate cooling of the pressure pad during operation of the pressure pad.

17. The pressure pad according to claim 1, wherein each one of the pair of opposed chevrons has a substantially pentagon shaped transversed cross-section.

18. The pressure pad according to claim 1, wherein at least one of the plurality of dam pits has an adjustable height, to compensate for wear of the at least one of the plurality of dam pits, during operation of the pressure pad, and maintaining a top sealing surface of the at least one of the plurality of dam pits in the first plane.

19. A pressure pad for sealing a base of a carton made from paperboard, the pressure pad comprising:

a top surface being generally flat and defining an intermediate plane of the pressure pad, the top surface of the pressure pad having a plurality of components extending from the top surface of the pressure pad and lying in a first plane, and the pressure pad having a plurality of components recessed into the top surface of the pressure pad and lying in a third plane, and at least the plurality of components which lie in the first and intermediate planes facilitate sealing of the base of the carton made from paperboard;

the pressure pad having a pair of opposed chevrons being located in a central portion of the top surface of the pressure pad, a set of parallel arranged railroad tracks, for engaging with a glue panel of the paperboard, being spaced from the pair of chevrons and located in a quadrant of the pressure pad, and a plurality of dam pits located to facilitate sealing of the base of the carton made from paperboard, and the pair of chevrons, the set of railroad tracks and the plurality of dam pits all extend from the top surface of the pressure pad and lie in the first plane;

at least four railroad tracks provided on the pressure pad and the at least four railroad tracks arranged parallel to one another for engaging with a glued panel of the paperboard and facilitate proper sealing thereof during operation of the pressure pad;

at least one of the plurality of dam pits having an adjustable height to compensate for wear of the at least one of the plurality of dam pits, during operation of the pressure pad, and maintaining a top sealing surface of the at least one of the plurality of dam pits in the first plane;

a pair of major relief areas provided in the top surface of the pressure pad, one of the pair of major relief areas located between one of the pair of chevrons and an outer edge portion of the pressure pad, and the other of the pair of major relief areas located between the other of the pair of chevron and an opposite outer edge portion of the pressure pad, and a base of the pair of the major relief areas lying in the third plane;

at least three minor triangular shaped relief areas provided in the pressure pad adjacent the pair of major relief areas, and a base of the at least three minor triangular shaped relief areas lying in the third plane;

a plurality of recesses formed in a top surface of the pressure pad, and the plurality of recesses each having a planar surface lying in the third plane and the plurality recesses formed in a top surface of the pressure pad provide areas which relieve pressure and prevent burn-out during sealing of the base of the carton made from paperboard.

20. A method for sealing a carton made from paperboard with a pressure pad, said method comprising the steps of:

defining is a generally flat top surface of a pressure pad having an intermediate plane which facilitates sealing of the base of the carton made from paperboard;

extending a plurality of components, from the top surface of the pressure pad, so as to lie in a first plane and facilitate sealing of the base of the carton made from paperboard;

recessing a plurality of components, into the top surface of the pressure pad, so as to lie in a third plane;

locating a pair of opposed chevrons in a central portion of the top surface of the pressure pad and lying in the first plane;

spacing a set of parallel arranged railroad tracks, for engaging with a glue panel of the paperboard, from the pair of chevrons in a quadrant of the pressure pad and lying in the first plane;

locating a plurality of dam pits to lie in the first plane and facilitate sealing of the base of the carton made from paperboard;

forming a plurality of recesses in a top surface of the pressure pad, and the plurality of recesses each having a planar surface lying in the third plane and the plurality recesses formed in a top surface of the pressure pad provide areas which relieve pressure and prevent burn-out during sealing of the base of the carton made from paperboard.

* * * * *